United States Patent [19]

Dörpmund

[11] 4,286,507

[45] Sep. 1, 1981

[54] SHIPPING CONTAINER CONSTRUCTION

[75] Inventor: Willi Dörpmund, Elze, Fed. Rep. of Germany

[73] Assignee: Graaff Kommanditgesellschaft, Elze, Fed. Rep. of Germany

[21] Appl. No.: 77,200

[22] Filed: Sep. 20, 1979

[30] Foreign Application Priority Data

Sep. 22, 1978 [DE] Fed. Rep. of Germany ..... 2648666

[51] Int. Cl.[3] ..... B65J 1/02; F24F 13/00

[52] U.S. Cl. ..... 98/32; 98/52; 220/1.5; 220/DIG. 27

[58] Field of Search ..... 98/6, 8, 3, 18, 32, 98/52; 220/1.5, 373, 374, DIG. 27

[56] References Cited

U.S. PATENT DOCUMENTS

| | | | |
|---|---|---|---|
| 205,634 | 7/1878 | Gouge | 98/6 |
| 657,743 | 9/1900 | Miller | 98/6 |
| 3,057,287 | 10/1962 | Gray | 98/114 X |
| 4,062,273 | 12/1977 | O'Connor | 98/8 |
| 4,169,407 | 10/1979 | Dorpmund | 98/32 |

FOREIGN PATENT DOCUMENTS

| | | | |
|---|---|---|---|
| 2648666 | 3/1978 | Fed. Rep. of Germany | 220/1.5 |

*Primary Examiner*—Allan N. Shoap
*Attorney, Agent, or Firm*—McGlew and Tuttle

[57] ABSTRACT

A shipping container comprises a container body which has a top, bottom and side walls with at least one of the side walls of the container having upper and lower longitudinally extending hollow chords. Each of the chords have top and bottom openings and interior baffles arranged to slope downwardly toward the openings for the removal of water and dirt entrained with air moving therethrough. The bottom wall of the container has a substantially U-shaped longitudinally extending beam which is located intermediate the length of the bottom wall and opens downwardly and has a top with at least one aperture therethrough and spaced upon said walls. A plurality of baffles are exposed in the beam and extend from a side wall downwardly toward the opposite side wall but terminate at spaced locations from the wall so that there is a downward opening therebetween.

1 Claim, 1 Drawing Figure

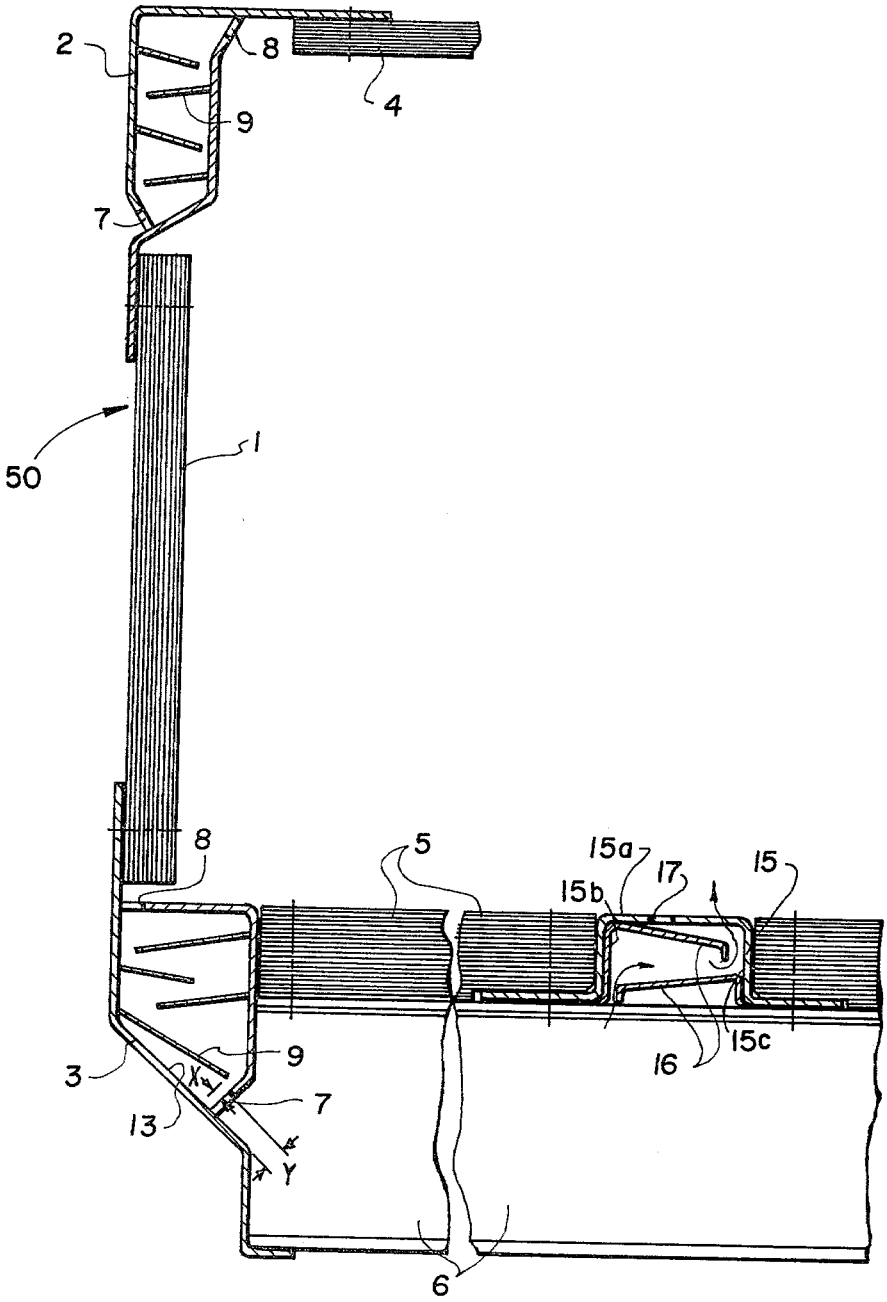
2
8
4
9
7
50
1
8
5
15a
17
15
15b
3
9
7
13
Y
16
15c
6

SHIPPING CONTAINER CONSTRUCTION

FIELD AND BACKGROUND OF THE INVENTION

This invention relates in general to shipping containers and in particular to a new and useful shipping container having upper and lower chords along each corner edge for ventilating a container and which also includes a bottom wall with a longitudinally extending beam therein having a baffle control for the flow of air therethrough.

The present invention is an improvement over U.S. patent application No. 844,059, filed Oct. 20, 1977 now U.S. Pat. No. 4,167,407 issued Oct. 2, 1979, and herein incorporated by reference.

In the construction of the container of U.S. Pat. No. 4,169,407, the container has a side wall which insures a satisfactory ventilation of ordinary shipped products. However, experience has shown that with some specific products, such as green peppers or cocoa, the ventilation in the central zone of the container during a longer transportation period is not satisfactory because of the thermal effect originating in the product itself.

SUMMARY OF THE INVENTION

The present invention provides an improved container which includes an arrangement for ventilating a central area of the container in order to create a satisfactory ventilating condition also for unique types of products which require it. With the inventive arrangement, a longitudinal chord is disposed intermediate the width or length of the bottom wall and it is of U-shaped downwardly opening construction, baffle means associated with it for the control flow of ventilating air therethrough.

Accordingly, it is an object of the invention to provide an improved container which include upper and lower hollow chords on one side wall having ventilating passage means therein and further including a bottom wall with a longitudinally extending beam having a top wall with a plurality of openings therethrough and baffle means associated with it for the defining flow paths at the interior of the beam.

A further object of the invention is to provide a shipping container which is simple in design, rugged in construction and economical to manufacture.

The various features of novelty which characterize the invention are pointed out with particularity in the claims and annexed to and forming a part of this disclosure. For a better understanding of the invention, its operating advantages and specific objects attained by its uses, reference is made to the accompanying drawing and descriptive matter in which a preferred embodiment of the invention is illustrated.

BRIEF DESCRIPTION OF THE DRAWINGS

The only FIGURE of the drawing is a partial transverse sectional view of a container constructed in accordance with the invention.

DESCRIPTION OF THE PREFERRED EMBODIMENT

Referring to the drawing, in particular the invention embodied therein comprises an improved shipping container generally designated 50 of which only a side portion is shown.

A side wall 1 extends between an upper hollow tubular chord 2 connected to the top wall 4 of the container, and a lower hollow tubular chord 3 connected to the container bottom 5 and a lower cross-beam 6. Both chords 2 and 3 are designed as hollow beams. Both the upper and lower chords 2 and 3 having a plurality of top and bottom apertures 8 and 7 and a plurality of substantially horizontal but somewhat downwardly directed baffles 9 at different levels between the apertures 7 and 8. In lower chord 3, a plurality of apertures 7 arranged in a horizontal row is provided, preferably in the lowermost portion thereof, on the inside facing cross-beam 6 and a plurality of apertures 8 arranged in a horizontal row is provided which establishes communication between the interior of the chord and the interior of the container, and preferably are kept clear from the shipped product by the lower face of side wall 1 slightly spaced therefrom. Between apertures 7 and 8, substantially horizontal baffles 9 slant toward apertures 7 are provided within lower chord 3. The baffles are arranged so as to project in alternately opposite directions, with the spacing x of the respective outer edges of baffles 9 from the opposite wall of lower chord 3 being smaller than the maximum width y of apertures 7, 8. It is important, in this connection, to ensure a uniform air velocity through the apertures over the total intake cross-sectional area, in order to avoid undesirable accumulations and also to obtain a complete precipitation on lower wall 13 of the rain water and dust entrained by the air taken in.

In bottom 5 of the container, one or more longitudinal beams are provided which extend parallel to lower chord 3 and have a downwardly open hat section or U-shaped cross-section with a top wall portion **15*a* and side leg portions 15*b* and 15*c*. Within longitudinal beams 15, downwardly slanting baffles 16 are provided which project from both sides, alternately in opposite directions, and have their free edges angled, in order to effectively catch and allow precipitation of the dirt contained in the air. In the top wall 15*a*, bordering on the interior of the container, of each longitudinal beam 15, a plurality of apertures 17 is provided which may be of any design and arrangement, even staggered. The height of longitudinal beam 15** corresponds to the thickness of the container bottom.

The ventilation in accordance with the U.S. Pat. No. 4,169,407 provides that due to the arrangement and design of upper chord 2, an underpressure is produced in the upper part of the container, and due to the arrangement and design of lower chord 3, an excess pressure is produced, so that a uniform air exchange is obtained. Now, with the arrangement and design of longitudinal beams 15, in connection with cross-beams 6, an underpressure is produced also in the central zone of the container, so that no action of heat originating in the shipped product can become effective in that area. The enlarged cross-sectional area of ventilation in the lower part of the container, obtained by the provision of any desired number of longitudinal beams 15, makes it possible, in addition, to adapt the air flow velocity within the container to the nature of the shipped product.

While a specific embodiment of the invention has been shown and described in detail to illustrate the application of the principles of the invention, it will be understood that the invention may be embodied otherwise without departing from such principles.

What is claimed is:

1. An improved ventilation arrangement in the bottom wall of a shipping container of the type having top, bottom and side walls, at least one side of said container having upper and lower longitudinally extending hollow tubular chords adjacent the top and bottom of the side wall each having top and bottom openings, a plurality of downwardly inclined and oppositely directed deflectors within each of said upper and lower chords disposed between the openings of respective ones of the chords, the bottom wall connected to the lower chord having a cross-beam, and the bottom opening of the lower chord being directed toward the cross-beam and the top opening of the lower chord being directed toward the interior of the container to establish fluid communication therewith, the improvement comprising, in combination therewith, a continuous U-shaped longitudinally extending beam portion located intermediate the length of the bottom wall, said beam portion opening downwardly toward the cross-beam and having a top with at least one aperture extending therethrough to establish fluid communication between the interior of the container and the cross-beam, said beam portion having first and second spaced apart beam side walls connected to the bottom wall of the container, and one baffle in said beam portion on one of said beam side walls sloping downwardly toward the opposite beam side wall but spaced at its outer end from said opposite beam side wall to allow fluid communication around said one baffle, another baffle extending from said opposite beam side wall towards the first mentioned beam side wall and being adjacent the beam portion opening and arranged to also allow fluid communication therearound.

* * * * *